US010595131B2

(12) United States Patent
Vitt et al.

(10) Patent No.: US 10,595,131 B2
(45) Date of Patent: Mar. 17, 2020

(54) AUDIO SPEAKER HAVING AN ELECTRICAL PATH THROUGH A MAGNET ASSEMBLY

(71) Applicant: Apple Inc., Cupertino, CA (US)

(72) Inventors: Nikolas T. Vitt, Sunnyvale, CA (US); Christopher Wilk, Los Gatos, CA (US); David M. Pelletier, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/254,942

(22) Filed: Sep. 1, 2016

(65) Prior Publication Data

US 2017/0085992 A1 Mar. 23, 2017

Related U.S. Application Data

(60) Provisional application No. 62/221,506, filed on Sep. 21, 2015.

(51) Int. Cl.

| | |
|---|---|
| ***H04R 9/02*** | (2006.01) |
| ***H01F 7/02*** | (2006.01) |
| ***H04R 9/06*** | (2006.01) |

(52) U.S. Cl.

CPC ..... *H04R 9/025* (2013.01); *H01F 7/0289* (2013.01); *H04R 9/06* (2013.01); *H04R 2499/11* (2013.01)

(58) Field of Classification Search

CPC . H04R 9/06; H04R 1/288; H04R 7/18; H04R 9/025

USPC ..... 381/354

See application file for complete search history.

(56) References Cited

U.S. PATENT DOCUMENTS

| | | | | |
|---|---|---|---|---|
| 3,828,144 | A * | 8/1974 | Yamamuro | H04R 9/042 381/162 |
| 4,752,963 | A | 6/1988 | Yamazaki et al. | |
| 5,062,140 | A * | 10/1991 | Inanaga | H04R 1/345 381/399 |
| 2007/0076915 | A1* | 4/2007 | Shin | H04R 7/04 381/400 |
| 2009/0257617 | A1* | 10/2009 | Ikeda | H04R 9/047 381/410 |

(Continued)

FOREIGN PATENT DOCUMENTS

| | | |
|---|---|---|
| CN | 1489880 A | 4/2004 |
| CN | 1891009 A | 1/2007 |

OTHER PUBLICATIONS

Chinese Office Action dated Oct. 12, 2018 for related Chinese Appln No. 2017-156885 3 Pages.

(Continued)

*Primary Examiner* — Sean H Nguyen

(74) *Attorney, Agent, or Firm* — Womble Bond Dickinson (US) LLP

(57) ABSTRACT

An audio speaker having a magnet assembly for directing a magnetic field through a magnetic circuit, and an electrical circuit for carrying an electrical audio signal current through at least part of the magnet assembly, are disclosed. More particularly, a voicecoil in the electrical circuit may be in electrical contact with a magnetic plate of the magnet assembly. The voicecoil may be electrically connected with a speaker driver circuit at least partly through the magnetic plate. Other embodiments are also described and claimed.

24 Claims, 13 Drawing Sheets

(56) References Cited

U.S. PATENT DOCUMENTS

| | | | | |
|---|---|---|---|---|
| 2012/0213398 | A1* | 8/2012 | Itoh | H04R 9/025 381/334 |
| 2012/0269378 | A1* | 10/2012 | Stead | H01F 7/0289 381/396 |
| 2015/0163597 | A1* | 6/2015 | Meng | H04R 9/025 381/412 |
| 2016/0212513 | A1* | 7/2016 | Honda | H04R 1/02 |

OTHER PUBLICATIONS

Second Chinese Office Action dated Mar. 28, 2019 for related Chinese Appln No. 201610833538.X 16 Pages.

* cited by examiner

B - B

DETAIL A

AUDIO SPEAKER HAVING AN ELECTRICAL PATH THROUGH A MAGNET ASSEMBLY

This application claims the benefit of U.S. Provisional Patent Application No. 62/221,506, filed Sep. 21, 2015, and this application hereby incorporates herein by reference that provisional patent application in its entirety.

BACKGROUND

Field

Embodiments related to an audio speaker having an electrical circuit, for carrying an electrical audio signal current, and a magnet assembly, are disclosed. In an embodiment, the electrical circuit includes an electrical path passing through the magnet assembly.

Background Information

A portable consumer electronics device, such as a mobile phone, a tablet computer, or a portable media device, typically includes a system enclosure surrounding internal system components, such as audio speakers. Such devices may have small form factors with limited internal space. Thus, the integrated audio speakers may be microspeakers, also known as microdrivers, which are miniaturized implementations of loudspeakers having a broad frequency range.

Microspeakers typically include a magnetic circuit consisting of one or more magnets sandwiched between pieces of magnetic steel. The magnetic steel directs a magnetic field generated by the magnets toward a voicecoil. Thus, when an electrical audio signal current is delivered through the voicecoil, the voicecoil moves to generate sound. Terminal leads of the voicecoil are typically attached to a rigid substrate to receive the electrical audio signal. For example, the terminal leads may be welded to respective contact pads on the rigid substrate, and external leads may be routed into the microspeaker around the one or more magnets to electrically connect to the contact pads and deliver the electrical audio signal to the terminal leads.

SUMMARY

External leads, routed into and/or through a microspeaker to complete an electrical circuit with a voicecoil, occupy valuable space. If the number of external leads could be reduced, then space may be freed up to increase a size of a magnet for better sound output, or to shrink the microspeaker size even further.

In an embodiment, an audio speaker utilizes the electrical properties of a magnet assembly, in addition to the magnetic properties of the magnet assembly, to reduce the number of external leads routed through the audio speaker and/or the volume of space required for the routing. The audio speaker may include a diaphragm and a magnet assembly. An air gap may be located between an electrically conductive top plate and a center magnet of the magnet assembly. Furthermore, the electrically conductive top plate may laterally surround the center magnet. Thus, a wire coil having two terminals may be coupled to the diaphragm and suspended in the air gap, and may be laterally surrounded by the center magnet.

In an embodiment, a first terminal of the wire coil is in electrical contact with the top plate of the magnet assembly. For example, the first terminal may be attached, e.g., spot welded, to the top plate. The audio speaker may also include a printed circuit carrier, e.g., a flexible printed circuit, having several conductive pads. A first conductive pad may be in electrical contact with the top plate and a second conductive pad may be in electrical contact with the wire coil. For example, the first conductive pad may be attached, e.g., spot welded, to the top plate, and the second conductive pad may be attached, e.g., spot welded, to the second terminal of the wire coil. The conductive pads may be on opposite sides of the printed circuit carrier in essentially the same location. Furthermore, the first terminal and the second terminal of the wire coil may be separated along the top plate. Thus, the top plate may electrically connect first conductive pad to the first terminal. That is, the top plate may provide a segment of the electrical circuit of audio speaker.

In an embodiment, the electrically conductive top plate may include several electrically insulated portions. The first terminal of the wire coil may be in electrical contact with a first portion of the top plate, and the second terminal of the wire coil may be in electrical contact with a second portion of the top plate. The magnet assembly may further include a bottom plate below the center magnet and the top plate, e.g., the center magnet may be mounted on an electrically conductive bottom plate, and the bottom plate may include several electrically insulated portions. The first portion of the top plate may be electrically connected to a first portion of the bottom plate, and the second portion of the top plate may be electrically connected to a second portion of the bottom plate. The first portion of the bottom plate may be electrically insulated form the second portion of the bottom plate. Furthermore, the portions of the bottom plate may include respective contacts, e.g., a first bottom contact and a second bottom contact. Thus, the first bottom contact may be electrically connected to the first terminal through the first portions of the top and bottom plates, and the second bottom contact may be electrically connected to the second terminal through the second portions of the top and bottom plates.

The magnet assembly may include a side magnet positioned between the top plate and the bottom plate to generate a magnetic field. In an embodiment, the first terminal of the wire coil is attached to the first portion of the top plate at a first top contact and the second terminal of the wire coil is attached to the second portion of the top plate at a second top contact. The first top contact and the second top contact may be laterally offset from the side magnet such that electrical current passing through the contacts does not intersect the magnetic field.

In an embodiment, a center magnet and a side magnet extend over a gap between the portions of the top plate and/or bottom plate. The magnets may be insulated from the bottom plate and/or top plate, however, to prevent electrical shorting between the portions of the magnet assembly. For example, a first insulating bonding layer may be disposed between the center magnet and the bottom plate, and a second insulating bonding layer may be disposed between the side magnet and the bottom plate. Similarly, a third insulating bonding layer may be disposed between the side magnet and the top plate. The insulating bonding layers between the magnets and respective magnet assembly components may include an adhesive and/or one or more dielectric spacers.

In an embodiment, the side magnet may be between the top plate and the bottom plate, and the plates may be divided into portions by respective gaps. The first terminal of the wire coil may be in electrical contact with the first portion of the top plate, and the second terminal of the wire coil may be in electrical contact with the second portion of the top plate. The side magnet may include first and second magnet portions disposed between respective portions of the top plate and bottom plate. For example, the first magnet portion may be between the first top portion and the bottom plate, and the second magnet portion may be between the second top portion and the bottom plate. One or more dielectric spacers may also be disposed between magnet portions and the respective plate portions to insulate the magnet portions from the magnetic plate portions. Furthermore, the first magnet portion may be electrically insulated from the second magnet portion by a magnet gap, e.g., an air-filled void, which extends between the gaps that divide the magnetic plate portions.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

DETAILED DESCRIPTION

Figure 1:
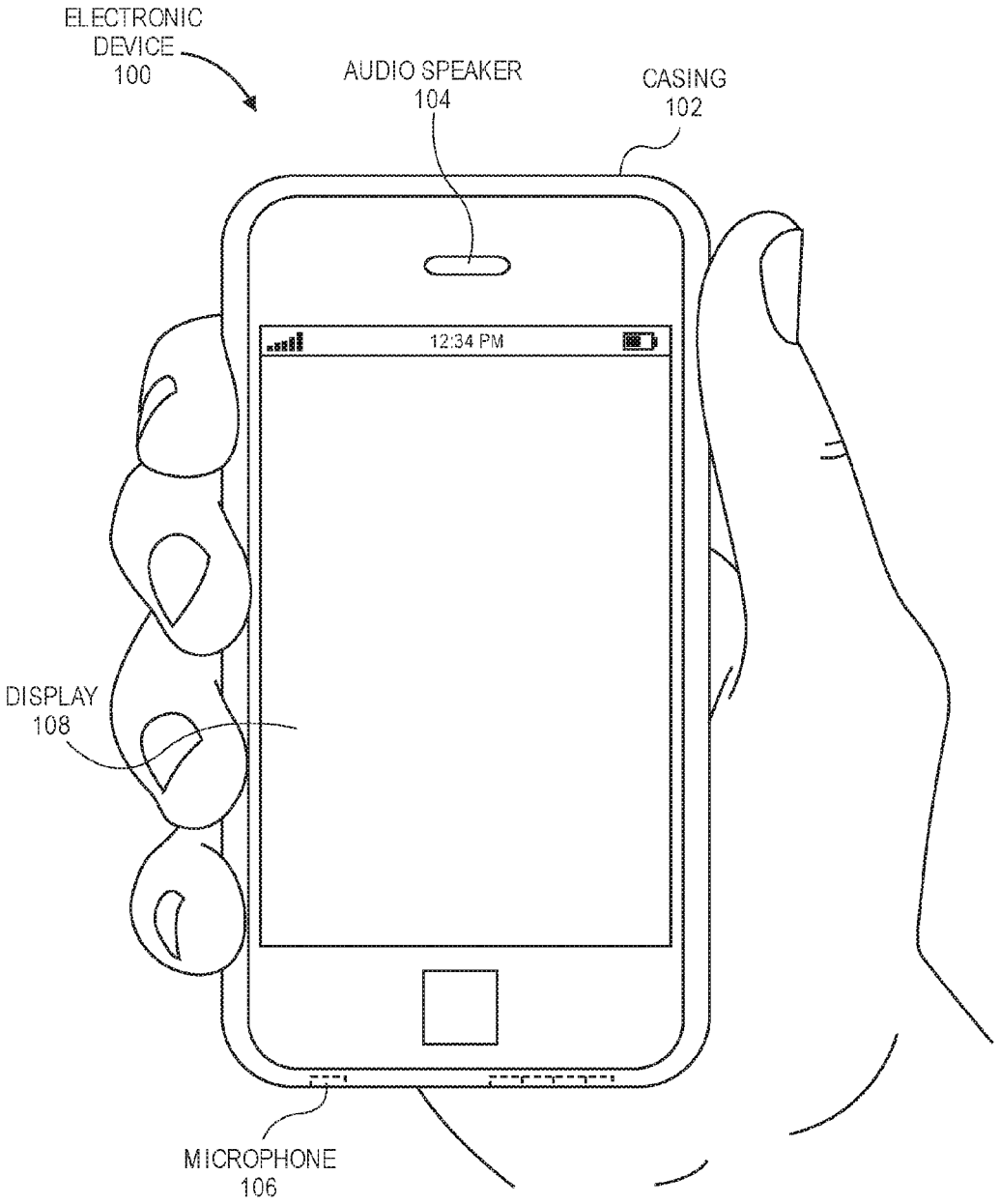
FIG. 1 is a pictorial view of an electronic device in accordance with an embodiment.

Embodiments describe an audio speaker having a magnet assembly for directing a magnetic field through a magnetic circuit, and an electrical circuit for carrying an electrical audio signal current through at least a portion of the magnet assembly. However, while some embodiments are described with specific regard to integration of the audio speaker within mobile electronics devices, such as handheld devices, the embodiments are not so limited and certain embodiments may also be applicable to other uses. For example, an audio speaker as described below may be incorporated into other devices and apparatuses, including desktop computers, laptop computers, wearable computers, or motor vehicles, to name only a few possible applications.

In various embodiments, description is made with reference to the figures. However, certain embodiments may be practiced without one or more of these specific details, or in combination with other known methods and configurations. In the following description, numerous specific details are set forth, such as specific configurations, dimensions, and processes, in order to provide a thorough understanding of the embodiments. In other instances, well-known processes and manufacturing techniques have not been described in particular detail in order to not unnecessarily obscure the description. Reference throughout this specification to "one embodiment," "an embodiment," or the like, means that a particular feature, structure, configuration, or characteristic described is included in at least one embodiment. Thus, the appearance of the phrase "one embodiment," "an embodiment," or the like, in various places throughout this specification are not necessarily referring to the same embodiment. Furthermore, the particular features, structures, configurations, or characteristics may be combined in any suitable manner in one or more embodiments.

The use of relative terms throughout the description may denote a relative position or direction. For example, "over" may indicate a first direction away from a reference point. Similarly, "under" may indicate a location in a second direction orthogonal to the first direction. Such terms are provided to establish relative frames of reference, however, and are not intended to limit the use or orientation of an audio speaker (or components of the audio speaker) to a specific configuration described in the various embodiments below.

In an aspect, an audio speaker includes a magnet assembly having several magnetic components arranged to focus a magnetic field in an air gap. A wire coil, e.g., a voice coil, may be suspended within the air gap to carry an electrical audio signal current through the magnetic field such that the wire coil and a diaphragm coupled to the wire coil move relative to the magnet assembly to generate sound. In an embodiment, the wire coil includes a first terminal and a second terminal, and at least one of the terminals is in electrical contact with the magnet assembly. For example, the first terminal may be attached to an electrically conductive top plate of the magnet assembly. In an embodiment, the second terminal is attached to a first conductive pad of a printed circuit carrier and a second conductive pad of the printed circuit carrier is attached to the top plate. Thus, the top plate forms a portion of the electrical circuit that carries electrical current through the wire coil. Accordingly, the electrical connection between the printed circuit carrier and the wire coil may be made at a single location on the top plate, eliminating a need for an additional external lead to connect to the first terminal of the wire coil. As such, space that would be occupied by the additional external lead may instead be used to increase the size of other speaker components, e.g., magnets of the magnet assembly, or to further miniaturize the audio speaker.

In an aspect, an audio speaker includes a wire coil having two terminals, both of which are attached to respective components of the magnet assembly. For example, a first terminal of the wire coil may be in electrical contact with a first portion of a top plate, and a second terminal of the wire coil may be in electrical contact with a second portion of the top plate. The first portion and the second portion of the top plate may be electrically insulated from each other, e.g., by an air gap, such that electrical current flowing into the first portion passes to the second portion through the wire coil. In an embodiment, the portions of the top plate are electrically connected to respective portions of a bottom plate in the magnet assembly. Accordingly, an electrical circuit may be formed through the bottom plate, the top plate, and the wire coil, eliminating a need for external leads to carry an electrical audio signal current to the wire coil terminals. As such, space that would be occupied by the external leads may instead be used to increase the size of other speaker components, e.g., magnets of the magnet assembly, or to further miniaturize the audio speaker.

Referring to FIG. 1, a pictorial view of an electronic device is shown in accordance with an embodiment. An electronic device 100 may be a smartphone device. Alternatively, it could be any other portable or stationary device or apparatus, such as a laptop computer, a tablet computer, a wearable computer, a wristwatch device, etc. Electronic device 100 may include various capabilities to allow the user to access features involving, for example, calls, voicemail, music, e-mail, internet browsing, scheduling, or photos. Electronic device 100 may also include hardware to facilitate such capabilities. For example, a casing 102 may contain an audio speaker 104, e.g., a microspeaker, to deliver a far-end voice to a near-end user during a call, and a microphone 106 to pick up the voice of the user during the call. Audio speaker 104 may also emit sounds associated with music files played by a music player application running on electronic device 100. A display 108 may present the user with a graphical user interface to allow the user to interact with electronic device 100 and/or applications running on electronic device 100. Other conventional features are not shown but may of course be included in electronic device 100.

Figure 2:
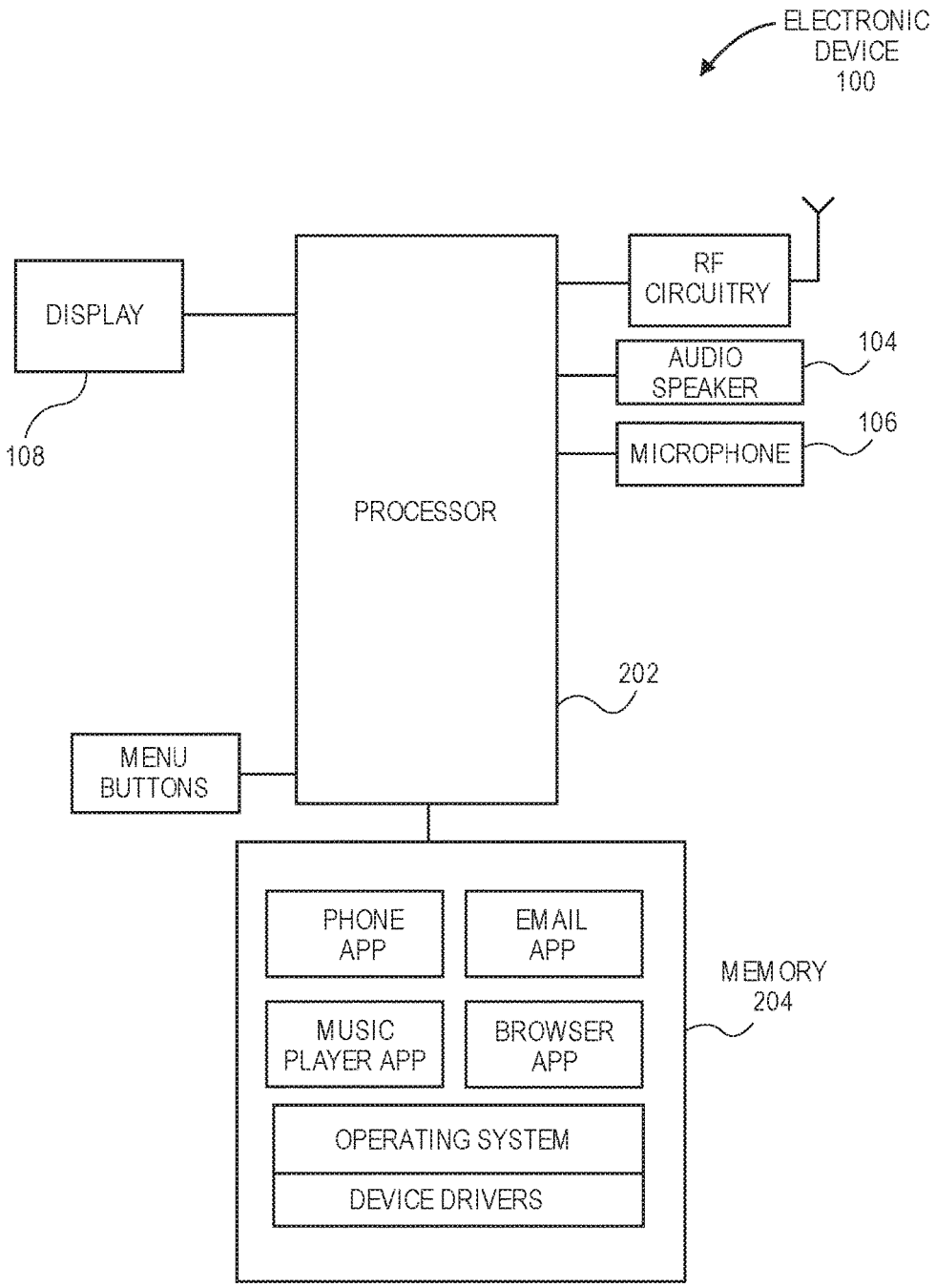
FIG. 2 is a schematic view of an electronic device in accordance with an embodiment.

Referring to FIG. 2, a schematic view of an electronic device is shown in accordance with an embodiment. As described above, electronic device 100 may be any of several types of portable or stationary devices or apparatuses with circuitry suited to specific functionality. Accordingly, the diagrammed circuitry is provided by way of example and not limitation. Electronic device 100 may include one or more processors 202 to execute instructions to carry out the different functions and capabilities described above. Instructions executed by processor(s) 202 of electronic device 100 may be retrieved from a local memory 204, and may be in the form of an operating system program having device drivers, as well as one or more application programs that run on top of the operating system. The instructions may cause electronic device 100 to perform the different functions introduced above, e.g., phone and/or music play back functions. To perform such functions, processor(s) 202 may directly or indirectly implement control loops and receive input signals from and/or provide output signals to other electronic components, such as audio speaker 104.

Figure 3:
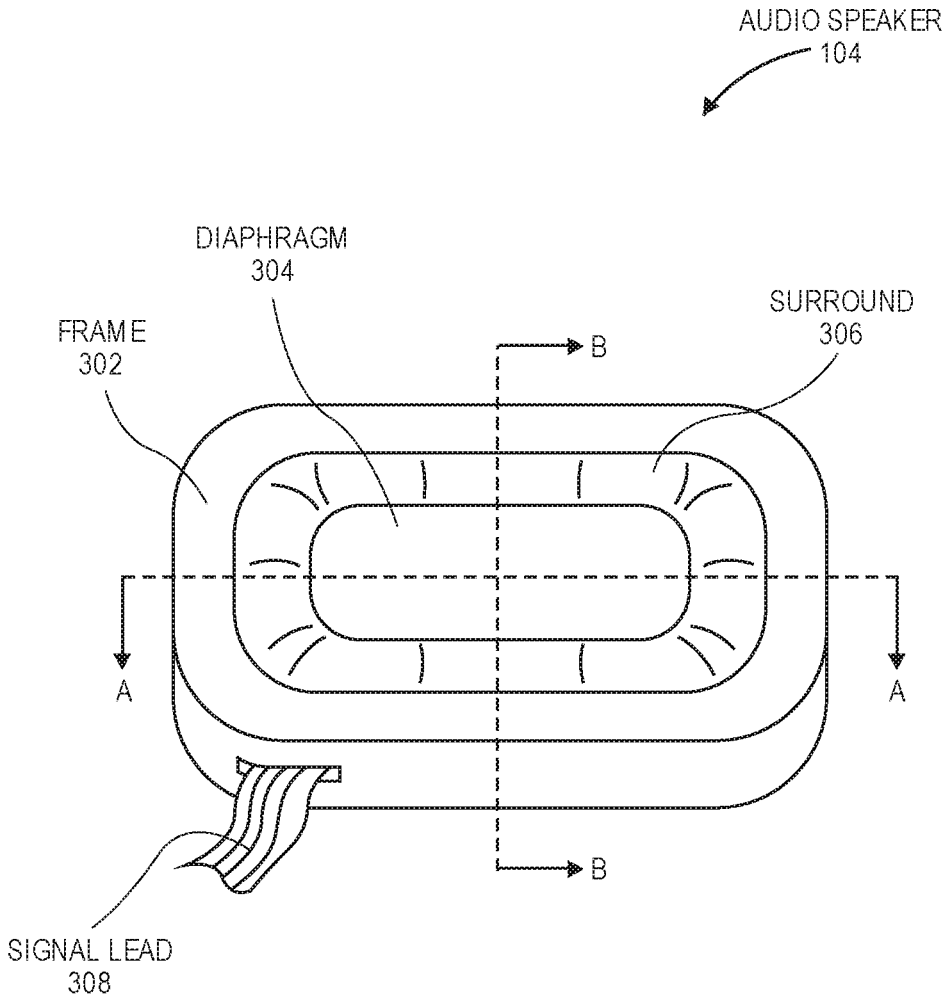
FIG. 3 is a perspective view of an audio speaker in accordance with an embodiment.

Referring to FIG. 3, a perspective view of an audio speaker is shown in accordance with an embodiment. An audio speaker 104 may be any type of loudspeaker. For example, audio speaker 104 may be a microspeaker. A microspeaker, also known as a microdriver, is a miniaturized implementation of a loudspeaker having a broad frequency range. Audio speaker 104 may have a small form factor defined by an exterior surface of a housing or a frame 302, a diaphragm 304, and a surround 306 suspending the diaphragm 304 relative to the housing or frame 302. These components may have various geometries that combine to create an outer envelope of audio speaker 104, and although the outer envelope is represented in FIG. 3 as having essentially a rectangular cuboid shape, the outer envelope may be other shapes, e.g., cylindrical, to facilitate placement of audio speaker 104 within a corresponding internal space of electronic device 100.

Audio speaker 104 may include a signal lead 308, e.g., one or more printed leads on a printed circuit carrier, that connects to an external audio driver amplifier. Signal lead 308 may be routed into and/or through frame 302 to connect to terminals of a voice coil, and to form an electrical circuit. As described below, portions of a magnet assembly within audio speaker 104 may complete the electrical circuit between the voice coil and signal lead 308.

Figure 4:
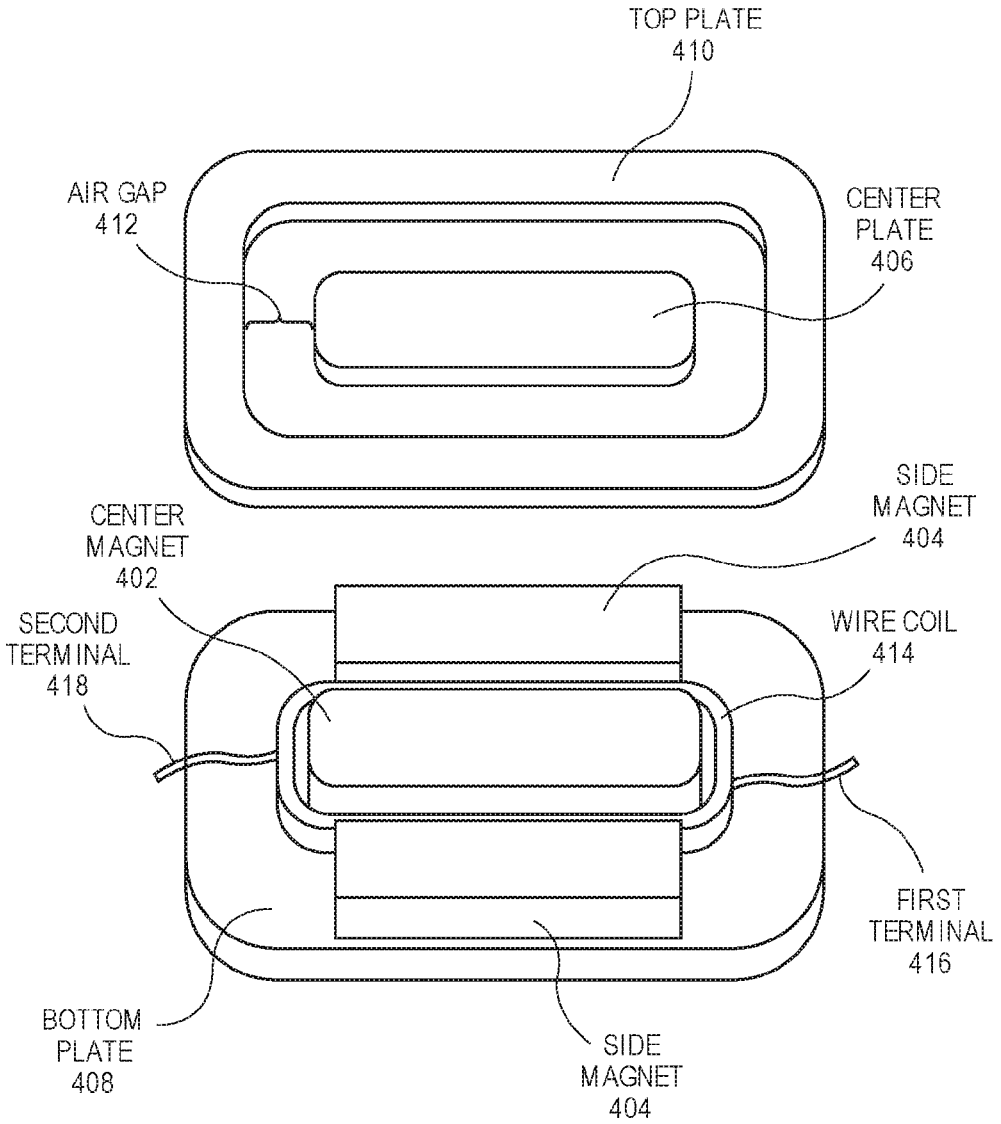
FIG. 4 is an exploded view of a portion of an audio speaker having a magnet assembly and a wire coil in accordance with an embodiment.

Referring to FIG. 4, an exploded view of a portion of an audio speaker having a magnet assembly and a wire coil is shown in accordance with an embodiment. A magnet assembly of audio speaker 104 may include several permanent magnet components and several components having high magnetic permeability. For example, the magnet assembly may include a three magnet design in which a center magnet 402 is flanked by two side magnets 404. Center magnet 402 and/or side magnets 404 may be mounted on bottom plate 408. Thus, center magnet 402 may be sandwiched between a center plate 406 and a bottom plate 408. Similarly, side magnets 404 may be sandwiched between a top plate 410 and bottom plate 408. Top plate 410 may laterally surround center magnet 402 and/or center plate 406. More particularly, top plate 410 may include an annular structure having a central opening such that center magnet 402 and/or center plate 406 are aligned with the central opening and top plate 410 circumscribes center magnet 402 and center plate 406 when viewed from the top. Accordingly, top plate 410 may be extend continuously at a constant or variable lateral distance from a center of center magnet 402 and/or center plate 406, e.g., over a circular or rectangular path around center magnet 402 and/or center plate 406. The magnets may be formed from the same or different types of permanent magnet materials, which may be any permanent magnet material known in the art. Similarly, the magnetic plates of the magnet assembly may be formed from known magnetic materials, including magnetic steel or other high permeability materials, e.g., high permeability iron-cobalt (FeCo) alloys.

In an embodiment, the arrangement of magnets and magnetic plates provide a magnetic circuit to direct a magnetic field generated by center magnet 402 and side magnets 404. The magnetic circuit may traverse center plate 406, top plate 410, and bottom plate 408 to form a magnetic loop. More particularly, center magnet 402 and side magnets 404 may be permanent magnets having respective opposite poles, and thus, center magnet 402 may generate a magnetic field in a first direction, e.g., upward, and side magnets 404 may generate a magnetic field in an opposite direction, e.g., downward. The magnetic fields may be conveyed laterally between the magnets through center plate 406, top plate 410, and bottom plate 408. More particularly, the magnetic field may flow laterally between center plate 406 and top plate 410 across an air gap 412. Air gap 412 may be an annular space around center magnet 402, and air gap 412 may separate center plate 406 from top plate 410. Accordingly, air gap 412 provides a void to receive another speaker component, such as a wire coil 414.

Wire coil 414 may be disposed within air gap 412 of a stationary magnet assembly of audio speaker 104. The wire coil 414 may include numerous turns or loops wound around a former having a cross-sectional shape similar to air gap 412. For example, the air gap 412 may be a cylindrical, annular void and the former may be a cylindrical, annular tube. The former may be attached to surround 306, and thus, surround 306 may suspend the former and wire coil 414 within air gap 412. Accordingly, by passing an electrical current through the loops of wire coil 414, a corresponding magnetic field may be produced. The corresponding magnetic field may react with the magnetic field focused in air gap 412 by the magnet assembly to move wire coil 414, the former, and surround 306. More particularly, diaphragm 304 attached to surround 306 may be moved to radiate sound from audio speaker 104.

The electrical current used to drive audio speaker 104 may be passed through wire coil 414 from a first end of the coil winding to a second end of the coil winding. More particularly, the first end may be part of a first terminal 416 of wire coil 414 and the second end may be part of a second terminal 418 of wire coil 414. The terminals of wire coil 414 include not only the ends but also a region of wire coil 414 between the windings and the ends, e.g., a 5-10 mm length of material near the ends, that may be placed in electrical contact with other audio speaker components to transfer the electrical current through the electrical circuit.

Figure 5:
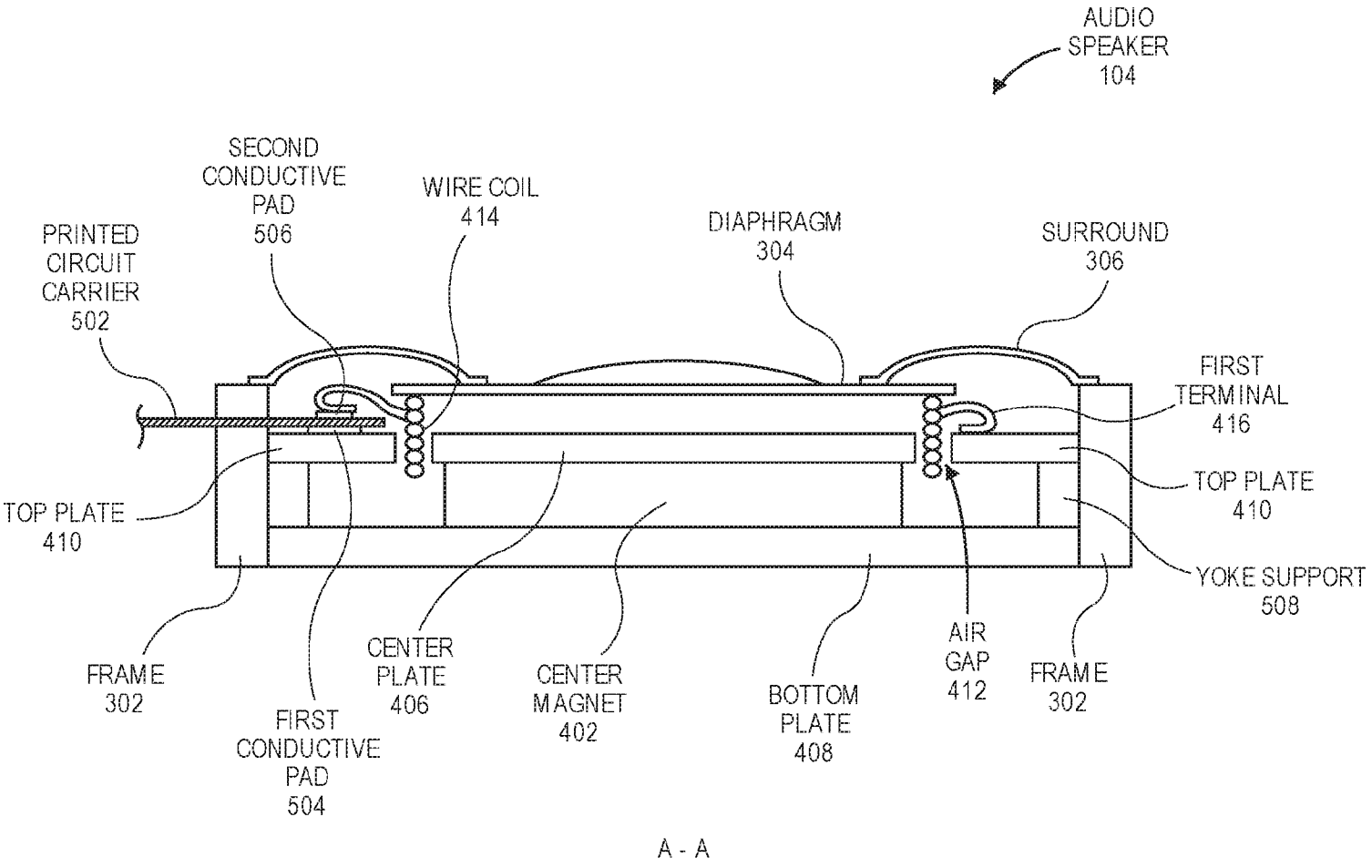
FIG. 5 is a sectional view, taken about line A-A of FIG. 3, of an audio speaker in accordance with an embodiment.

Referring to FIG. 5, a sectional view, taken about line A-A of FIG. 3, of an audio speaker is shown in accordance with an embodiment. Wire coil 414 may be connected to diaphragm 304 and suspended within air gap 412 by surround 306. More particularly, wire coil 414 may be positioned in air gap 412 between center plate 406 and top plate 410, and the magnetic circuit may pass between the plates to intersect wire coil 414. In an embodiment, at least one of the terminals of wire coil 414 is in electrical contact with a magnetic component of the magnet assembly. For example, first terminal 416 of wire coil 414 may be placed in electrical contact with top plate 410. Thus, an electrical audio signal current may pass through wire coil 414 into top plate 410 such that the electrical circuit carrying the audio signal includes wire coil 414 and at least a portion of top plate 410. The electrical circuit may be completed by one or more external leads electrically connected to wire coil 414 and/or top plate 410.

In an embodiment, a printed circuit carrier 502 electrically connects an external electrical component, such as an audio driver amplifier, with wire coil 414 and/or top plate 410 within audio speaker 104. Printed circuit carrier 502 may be, for example, a flexible printed circuit having one or more screen printed silver circuits on a polyester substrate. Printed circuit carrier 502 may also be another type of flexible circuit known in the art. The electrical leads of printed circuit carrier 502 may terminate at respective conductive pads, which may be placed in electrical contact with wire coil 414 and/or top plate 410. For example, a first electrical lead of printed circuit carrier 502 may terminate at a first conductive pad 504 that is placed in electrical contact with top plate 410. Similarly, a second electrical lead of printed circuit carrier 502 may terminate at a second conductive pad 506 that is placed in electrical contact with wire coil 414.

As described further below, printed circuit carrier 502 may attach to wire coil 414 and top plate 410 at a different location than a location where first terminal 416 attaches to top plate 410. For example, second conductive pad 506 of printed circuit carrier 502 may be spot welded to second terminal 418 at an opposite end of wire coil 414 from first terminal 416. Similarly, first conductive pad 504 of printed circuit carrier 502 may attach to top plate 410 at a contact point adjacent to second conductive pad 506, and thus, the contact point may be separated from the attachment of first terminal 416 to top plate 410 by essentially a same distance that second terminal 418 is separated from first terminal 416. In an embodiment, first conductive pad 504 is positioned on a first side of printed circuit carrier 502, e.g., on a bottom side of printed circuit carrier 502, and second conductive pad 506 is positioned on a second side of printed circuit carrier 502, e.g., on a top side of printed circuit carrier 502. Thus, first conductive pad 504 may face top plate 410 and second conductive pad 506 may face away from top plate 410 such that an electrical contact between printed circuit carrier 502 and top plate 410 may be at essentially the same lateral location as, e.g., vertically aligned with, the electrical contact between printed circuit carrier 502 and second terminal 418. The electrical contacts may nonetheless be electrically insulated from each other by the substrate of printed circuit carrier 502. More particularly, the electrical circuit within audio speaker 104 may have an input and an output terminal at essentially the same location to allow printed circuit carrier 502 to be routed to the single location through a single entrance in frame 302 and/or to minimize a volume of external leads being routed through the space within audio speaker 104.

An electrical audio signal current may flow through top plate 410 from the electrical contact with wire coil 414 to the electrical contact with printed circuit carrier 502. More particularly, first conductive pad 504 on printed circuit carrier 502 may be electrically connected to first terminal 416 of wire coil 414 through top plate 410. As shown in FIG. 4, top plate 410 may be shaped as a rectangular annulus having two short sides and two long sides connected at right angles. In an embodiment, first terminal 416 may be attached to top plate 410 on one of the short sides and first conductive pad 504 may be connected to top plate 410 on the other short side. Thus, electrical current may flow between the short side in contact with first terminal 416 and the short side in contact with printed circuit carrier 502 through at least one of the long sides. The electrical current may travel through top plate 410 around center magnet 402, which may be located laterally between the side segments of top plate 410.

Still referring to FIG. 5, top plate may be electrically insulated from other components of the magnet assembly to prevent electrical current from straying outside of an intended electrical circuit path. For example, top plate 410 may be supported above bottom plate 408 by frame 302, and frame 302 may be formed from a dielectric material such as a dielectric polymer to prevent the flow of electrical current from top plate 410 into frame 302. Top plate 410 may also be physically supported above bottom plate 408 by a structural feature, such as a yoke support 508, that separates top plate 410 from bottom plate 408. Such structural features may be formed from dielectric polymers to prevent the flow of electrical current from top plate 410 into bottom plate 408. Top plate 410 may be electrically insulated from center plate 406 and center magnet 402 by air gap 412. Thus, an electrical circuit between the terminal conductive pads of printed circuit carrier 502 may be routed through wire coil 414 and top plate 410, and may be isolated from other components of the magnet assembly.

Top plate 410 may be insulated to further prevent electrical shorting between a surface area of top plate 410 and an external structure or component. For example, top plate 410 may be masked or coated with an insulating material to cover the surface area of top plate 410, with the exception of the areas where an electrical connection is made between first terminal 416 or first conductive pad 504. In an embodiment, top plate 410 is coated by a dielectric material, e.g., an insulating polymer, and one or more opening is formed in the coating to attach first conductive pad 504 or first terminal 416 to top plate 410. Thus, electrical current may flow between the attachment points at the exposed openings through top plate 410. Furthermore, the electrical current may be constrained within the conductive portion of top plate 410 and insulated from the surrounding environment to reduce a likelihood of an electrical short between top plate 410 and an external structure or component.

Figure 6:
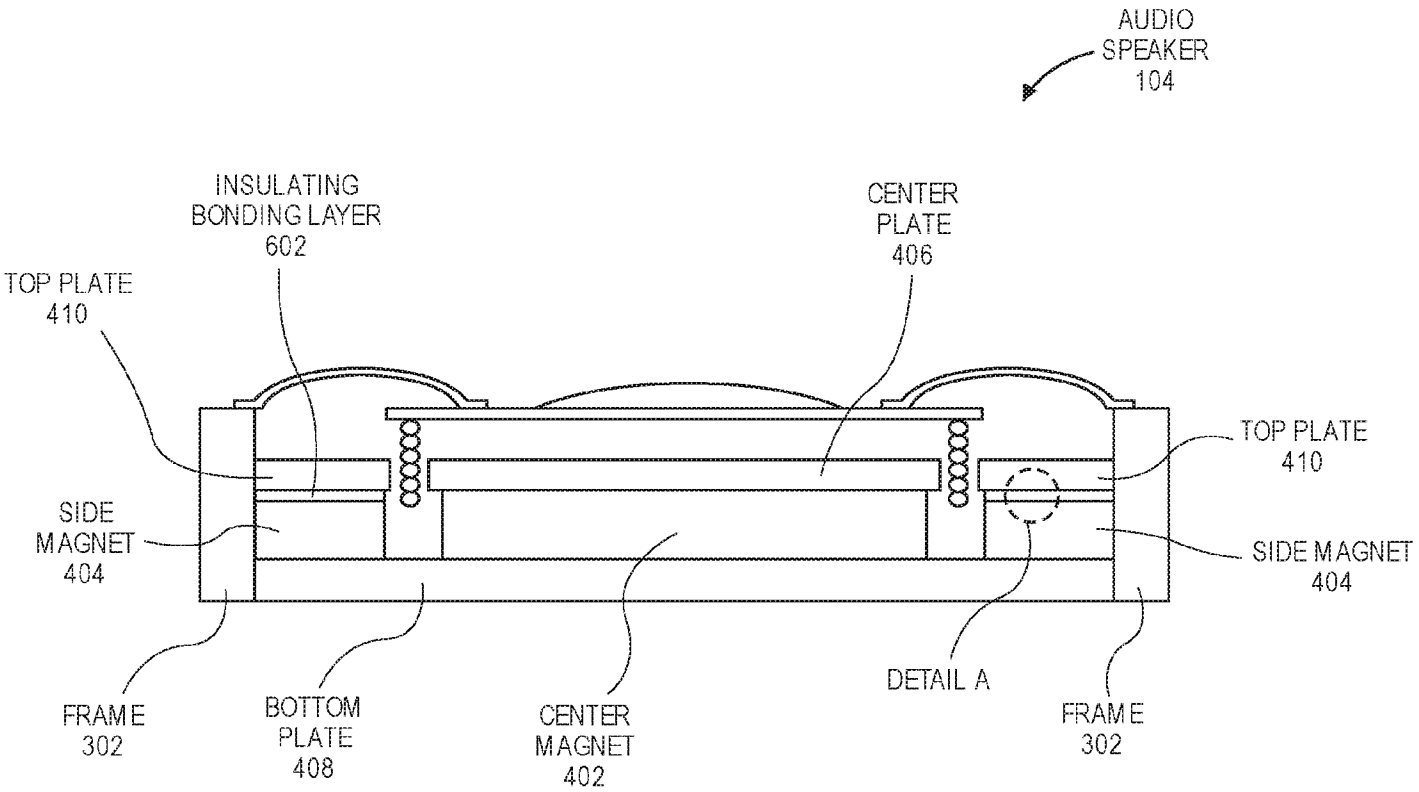
FIG. 6 is a sectional view, taken about line B-B of FIG. 3, of an audio speaker in accordance with an embodiment.

Referring to FIG. 6, a sectional view, taken about line B-B of FIG. 3, of an audio speaker is shown in accordance with an embodiment. Top plate 410 may include one or more sides positioned over side magnets 404. For example, when top plate 410 has a rectangular annulus shape, the long sides may rest on the side magnets 404, which may be sandwiched between top plate 410 and bottom plate 408. The magnets of the magnet assembly, e.g., side magnet 404, may be electrically conductive. For example, one or more of the magnets may have a zinc or nickel conductive plating, and thus, it may be necessary to insulate side magnets 404 from top plate 410 to prevent the electrical audio signal current within top plate 410 from passing into the magnets. Accordingly, an insulating bonding layer 602 may be disposed between top plate 410 and side magnet 404.

Figure 7:
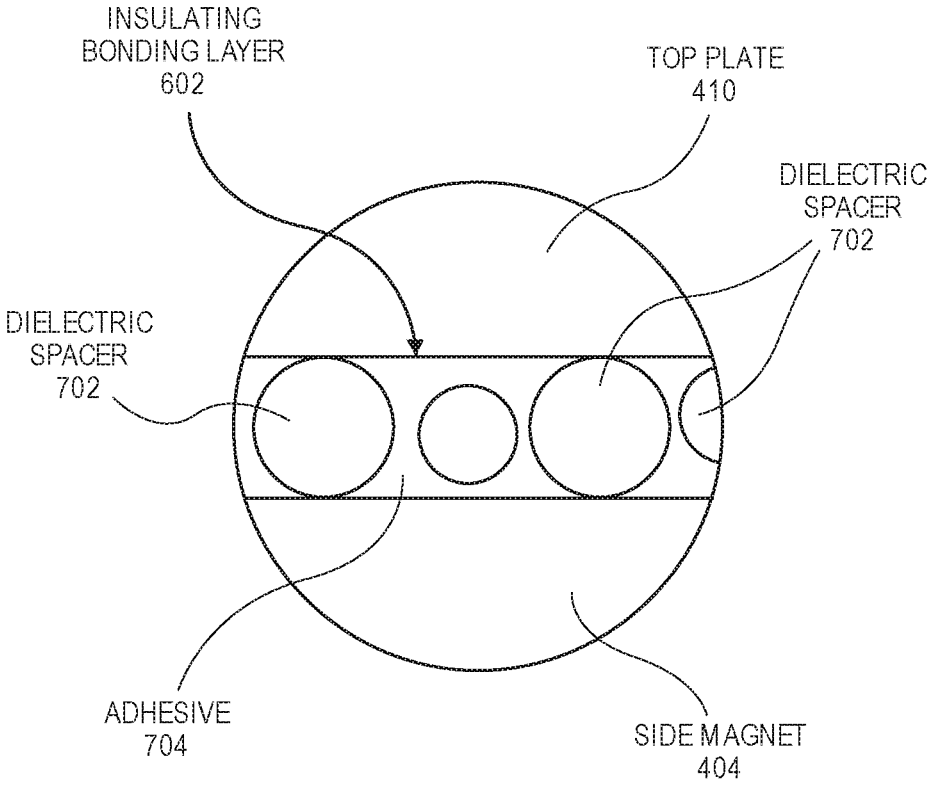
FIG. 7 is a detail view, taken from Detail A of FIG. 6, of an insulating bonding layer in accordance with an embodiment.

Referring to FIG. 7, a detail view, taken from Detail A of FIG. 6, of an insulating bonding layer is shown in accordance with an embodiment. Insulating bonding layer 602 may electrically insulate one component of the magnet assembly from another component of the magnet assembly, and may also physically connect the magnet assembly components to each other. For example, insulating bonding layer 602 may be disposed between top plate 410 and side magnet 404 to space top plate 410 and side magnet 404 apart by a predetermined distance. More particularly, insulating bonding layer 602 may include one or more dielectric spacer 702 pressed between top plate 410 and side magnet 404. Dielectric spacer 702 may have a predetermined outer dimension and a rigidity that prevents top plate 410 and side magnet 404 from squeezing together to make electrical contact with each other during assembly or use. For example, dielectric spacer 702 may be a glass bead having a predetermined diameter such that the bead physically contacts top plate 410 and side magnet 404 to separate the components. In an embodiment, dielectric spacers 702 provide a gap between the spaced components. Furthermore, at least a portion of the gap may be filled by a second dielectric material. For example, dielectric spacers 702 may be suspended within an adhesive 704. Adhesive 704 may bind dielectric spacers 702 together, and may adhere top plate 410 to side magnet 404.

Figure 8:
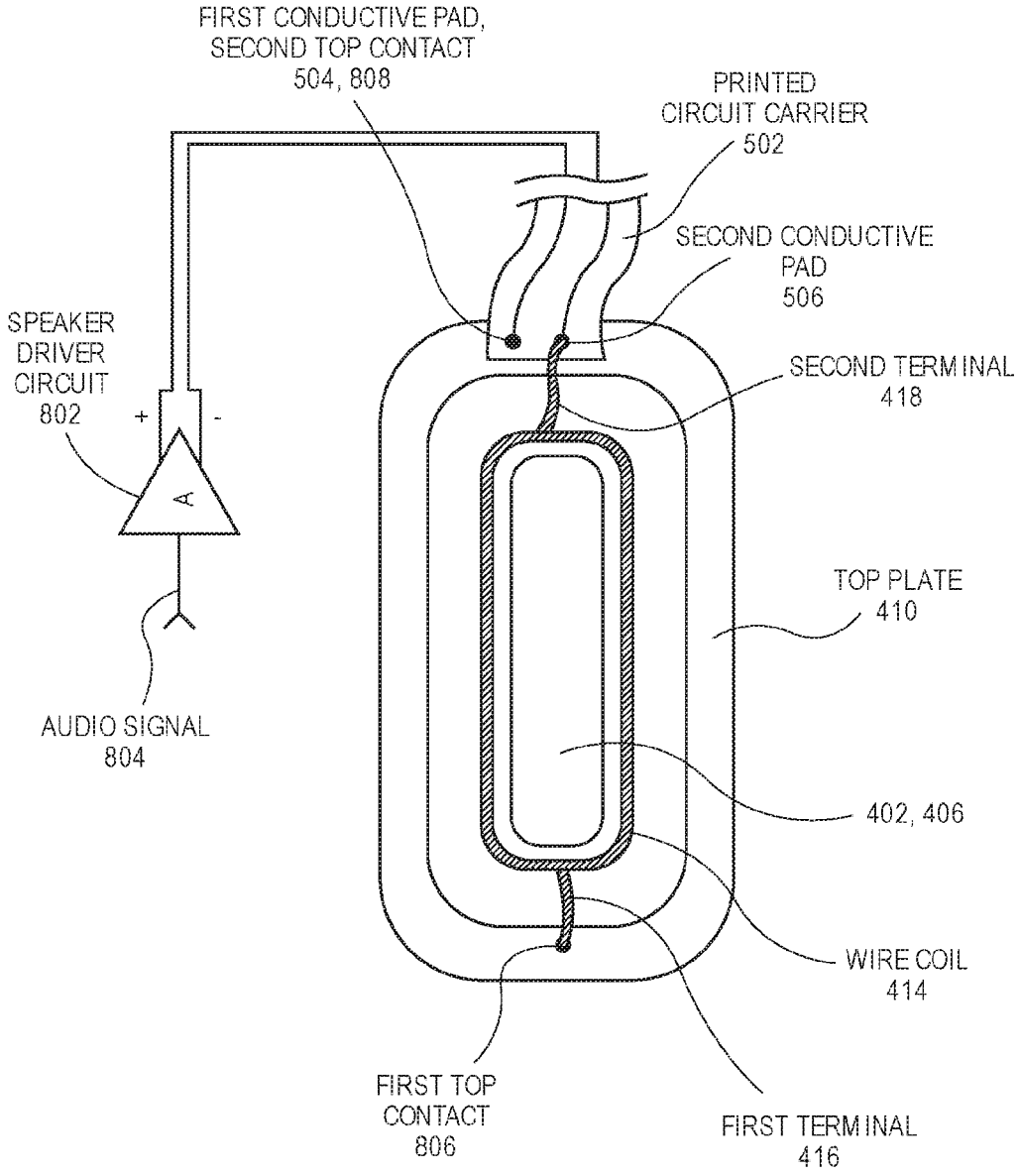
FIG. 8 is a top view of a portion of an audio speaker having a wire coil electrically connected to a magnet assembly in accordance with an embodiment.

Referring to FIG. 8, a top view of a portion of an audio speaker having a wire coil electrically connected to a magnet assembly is shown in accordance with an embodiment. The electrical current path through the magnet assembly may complete an electrical circuit with an external electronic components. For example, electrical leads of printed circuit carrier 502 connected to first conductive pad 504 and second conductive pad 506 may extend away from audio speaker 104 to a speaker driver circuit 802. Speaker driver circuit 802 may be, for example, an audio driver amplifier that receives an audio signal 804 from electronic device 100 circuitry and amplifies the signal to provide the electrical current that passes through wire coil 414 and top plate 410. More particularly, the electrical current may be input to first conductive pad 504 and output from second conductive pad 506, or vice versa.

In an embodiment, first conductive pad 504 and second conductive pad 506 are positioned along a same length of top plate 410. More particularly, first conductive pad 504 may be laterally adjacent to second conductive pad 506 on printed circuit carrier 502. Second conductive pad 506 may be above a substrate of printed circuit carrier 502, and thus, second terminal 418 of wire coil 414 may extend over a top surface of top plate 410 and above printed circuit carrier 502 to be spot welded to second conductive pad 506. Similarly, first terminal 416 of wire coil 414 may extend over the top surface of top plate 410 to connect to top plate 410 at a first top contact 806. Accordingly, the electrical current may pass between second conductive pad 506 and first top contact 806 through wire coil 414. As such, the electrical current may travel through wire coil 414 around center magnet 402 and within air gap 412. Thus, the electric current may pass through the magnetic field of audio speaker 104. The electrical current may then travel between first top contact 806, located on a first length of top plate 410, and the second top contact 808, located on a second length of top plate 410. Second top contact 808 may also be on the top surface of top plate 410, e.g., may be at a location where first conductive pad 504 is spot welded to the top surface of top plate 410. Thus, center magnet 402 may be laterally between first top contact 806 and second top contact 808 such that the electrical current travels through top plate 410 around center magnet 402 and air gap 412.

Figure 9:
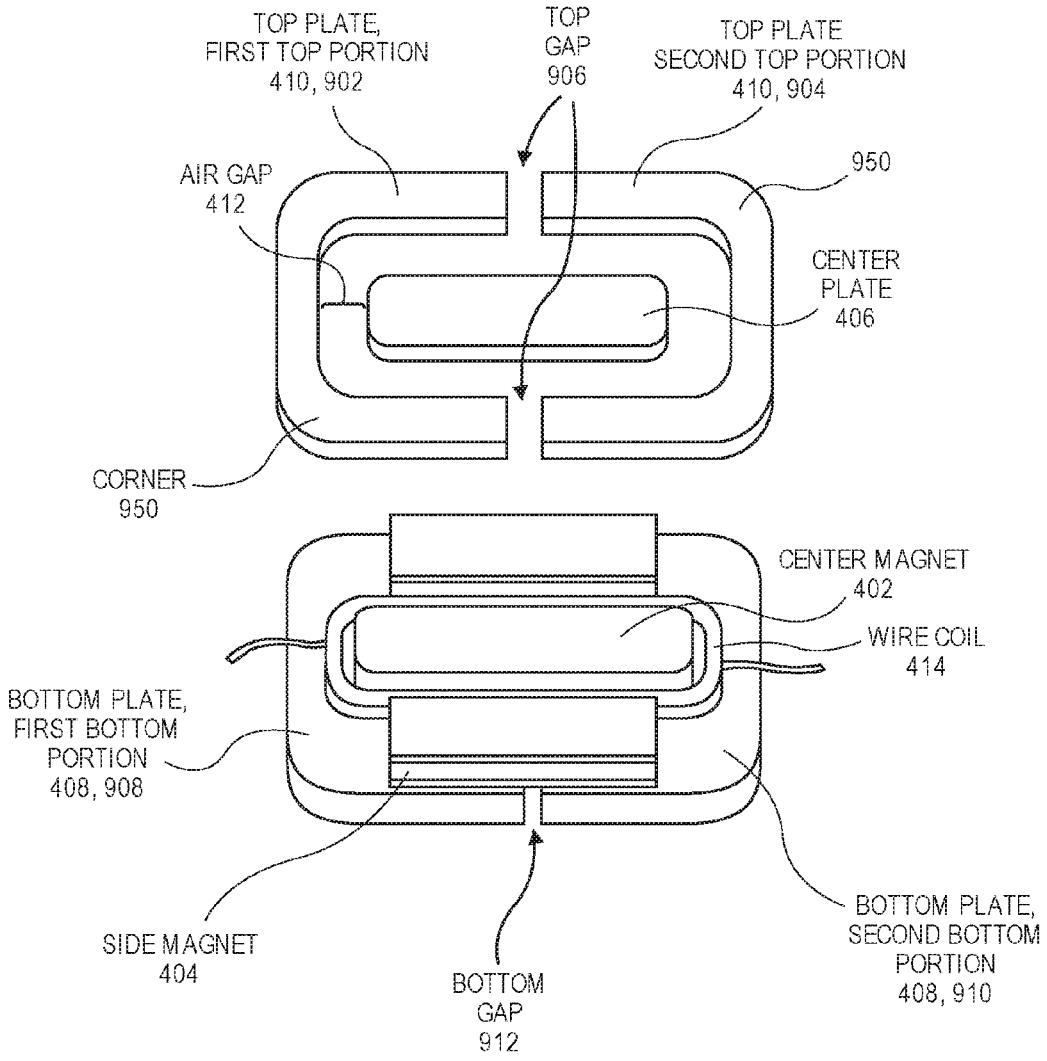
FIG. 9 is an exploded view of a portion of an audio speaker having a magnet assembly and a wire coil in accordance with an embodiment.

Referring to FIG. 9, an exploded view of a portion of an audio speaker having a magnet assembly and a wire coil is shown in accordance with an embodiment. The electrical audio signal current may pass through several components of the magnet assembly. More particularly, in an embodiment, first terminal 416 and second terminal 418 of wire coil 414 are in electrical contact with one or more component of the magnet assembly. The magnet assembly may have a three magnet design similar to that described above with respect to FIG. 4. Thus, center magnet 402 and two side magnets 404 may be sandwiched between top plate 410 and bottom plate 408 to form an air gap 412 within which wire coil 414 is suspended. Accordingly, the magnet assembly may provide a magnetic circuit having a magnetic field focused in air gap 412 between center plate 406 and top plate 410 (or center magnet 402). One or more of top plate 410 and bottom plate 408, however, may be segmented into electrically insulated portions.

In an embodiment, top plate 410 includes a first top portion 902 physically separated from a second top portion 904 by a top gap 906. Top gap 906 may be a void between first top portion 902 and second top portion 904, e.g., an air gap 412. Alternatively, top gap 906 may be filled by a dielectric material that physically connects first top portion 902 to second top portion 904 while electrically insulating first top portion 902 from second top portion 904. Top gap 906 may be sized and positioned to not significantly alter a strength of the magnetic field within the magnetic circuit. Accordingly, top gap 906 may have a width that is small compared to a length of side magnet 404. For example, a width of top gap 906 may be less than 10% of a length of side magnet 404. Furthermore, top gap 906 may be located away from the densest region of magnetic flux in the magnetic circuit. For example, although a pair of top gaps 906 is shown as being located in the middle of the long sides of top plate 410, the pair of top gaps 906 may instead be positioned at the corners 950 of top plate 410 away from side magnets 404 such that maximum top plate 410 material is maintained over side magnet 404. Thus, a pair of top gaps 906 may separate top plate 410 into first and second portions that are electrically isolated from one another without affecting the magnetic circuit of audio speaker 104.

Bottom plate 408 may also be split into portions that are electrically insulated from each other. For example bottom plate 408 may include a first bottom portion 908 physically separated from a second bottom portion 910 by a bottom gap 912. Thus, first bottom portion 908 may be electrically insulated from second bottom portion 910. Bottom gap 912 may be configured in a manner similar to top gap 906, e.g., may include an air gap, a dielectric spacing component, or a dielectric coupling that physically connects first bottom portion 908 to second bottom portion 910 while electrically insulating the portions from each other. Also like top gap 906, bottom gap 912 may be sized and positioned to not affect the magnetic circuit of audio speaker 104. Accordingly, the magnet assembly of FIG. 9 having top plate 410 and or bottom plate 408 split into several components may function magnetically in a manner similar to the magnet assembly illustrated in FIG. 4.

Figure 10:
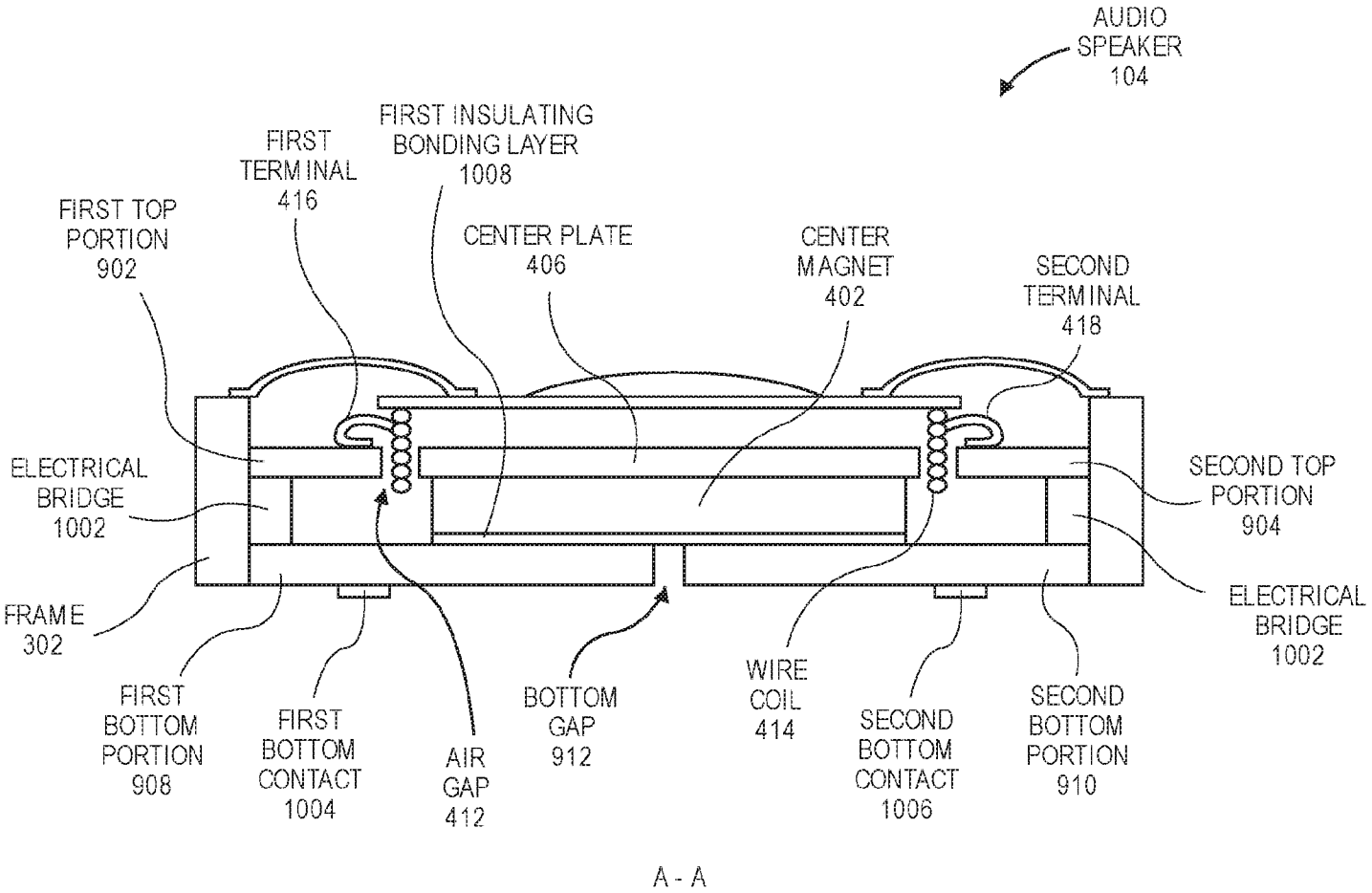
FIG. 10 is a sectional view, taken about line A-A of FIG. 3, of an audio speaker in accordance with an embodiment.

Referring to FIG. 10, a sectional view, taken about line A-A of FIG. 3, of an audio speaker is shown in accordance with an embodiment. Wire coil 414 suspended within air gap 412 may include first terminal 416 extending away from center magnet 402 toward top plate 410 in a first direction and second terminal 418 extending away from center magnet 402 toward top plate 410 in a different direction. More particularly, first terminal 416 may extend over first top portion 902 of top plate 410 and second terminal 418 may extend over second top portion 904 of top plate 410. In an embodiment, first terminal 416 is in electrical contact with first top portion 902 and second terminal 418 is in electrical contact with second top portion 904. For example, the terminals may be spot welded to the top surface of respective portions of top plate 410. Thus, the electrical circuit of audio speaker 104 may pass through both first top portion 902 and second top portion 904. Furthermore, as described above, first top portion 902 may be electrically insulated from second top portion 904 such that the electrical circuit does not short through top plate 410, but rather, the electrical audio signal current passes between first terminal 416 and second terminal 418 through wire coil 414.

In an embodiment, the electrically insulated portions of top plate 410 are electrically connected to respective portions of bottom plate 408. First top portion 902 may be electrically connected to first bottom portion 908 through an electrical bridge 1002. Similarly, second top portion 904 may be electrically connected to second bottom portion 910 through a respective electrical bridge 1002. Electrical bridge 1002 may support and space top portions relative to respective bottom portions in a manner similar to yoke support 508 described above. Rather than insulating top plate 410 from bottom plate 408, however, electrical bridge 1002 may be at least partly formed from a conductive material to provide an electrical path for electrical current to flow between top plate 410 and bottom plate 408 through electrical bridge 1002. In an embodiment, top plate 410 and bottom plate 408 may be physically supported by frame 302, and thus, electrical bridge 1002 may be a conductive wire that does not support the plates, but rather, is spot welded to the magnetic plates to provide electrical continuity between the plates.

Bottom plate 408, which may be electrically connected to wire coil 414 through electrical bridge 1002 and top plate 410, may also provide an electrical connection with external components. More particularly, bottom plate 408 may include an input and output contact for an electrical audio signal current from speaker driver circuit 802. In an embodiment, a first bottom contact 1004 is disposed on first bottom portion 908 and a second bottom contact 1006 is disposed on second bottom portion 910. The bottom contacts may be printed, sputtered, or otherwise formed on, or attached to, a surface of bottom plate 408 facing away from an internal volume of audio speaker 104. Thus, first bottom contact 1004 and second bottom contact 1006 may be placed in electrical contact with external electrical components by simply placing audio speaker 104 onto the external electrical component. For example, audio speaker 104 may be mounted on a flexible printed circuit having conductive pads or a main logic board having spring contacts such that the bottom contacts of bottom plate 408 electrically contact the external conductive pads and/or spring contacts. Audio speaker 104 may then be secured relative to the external electrical component, e.g., by solder, screws, or other fasteners, to make a secure electrical contact for receiving an electrical audio signal supplied by the external electrical component. Thus, it will be appreciated that the bottom contacts on bottom plate 408 eliminate the requirement to route external leads into the internal volume of audio speaker 104. By removing such external leads, audio speaker 104 may be further miniaturized.

Still referring to FIG. 10, audio speaker 104 may include an electrical circuit extending from first bottom contact 1004 through first bottom portion 908, electrical bridge 1002, and first top portion 902 into first terminal 416 of wire coil 414. The electrical circuit may continue through wire coil 414 to second terminal 418 and into second top portion 904. Furthermore, electrical current from second terminal 418 may pass through second top portion 904, electrical bridge 1002, and second bottom portion 910 to complete the electrical circuit at second bottom contact 1006. Accordingly, wire coil 414 and several components of the magnet assembly of audio speaker 104 may form the electrical circuit of audio speaker 104. As described above, an electrical circuit passing through the magnet assembly may essentially be split into halves, i.e., a first half (having first top portion 902 and first bottom portion 908) that is electrically insulated from a second half (having second top portion 904 and second bottom portion 910). Also as described above, the electrical circuit of audio speaker 104 that includes electrical paths passing through components of the magnet assembly may be electrically insulated from the permanent magnets of magnet assembly.

In an embodiment, center plate 406 and center magnet 402 are separated from top plate 410 portions by air gap 412, and thus, center plate 406 and center magnet 402 are electrically insulated from top plate 410. Center magnet 402 may, however, be disposed on bottom plate 408. More particularly, center magnet 402 may be mounted on first bottom portion 908 and second bottom portion 910, and center magnet 402 may extend over bottom gap 912 to form a bridge between first bottom portion 908 and second bottom portion 910. To prevent an electrical short between first bottom portion 908 and second bottom portion 910 through center magnet 402, a first insulating bonding layer 1008 may be disposed between center magnet 402 and the bottom plate 408 portions. First insulating bonding layer 1008 may be similar to insulating bonding layer 602 described above. That is, first insulating bonding layer 1008 may include one or more dielectric spacer to electrically insulate center magnet 402 from the bottom plate 408 portions. First insulating bonding layer 1008 may also include an adhesive to securely mount center magnet 402 on the bottom plate 408 portions.

Figure 11:
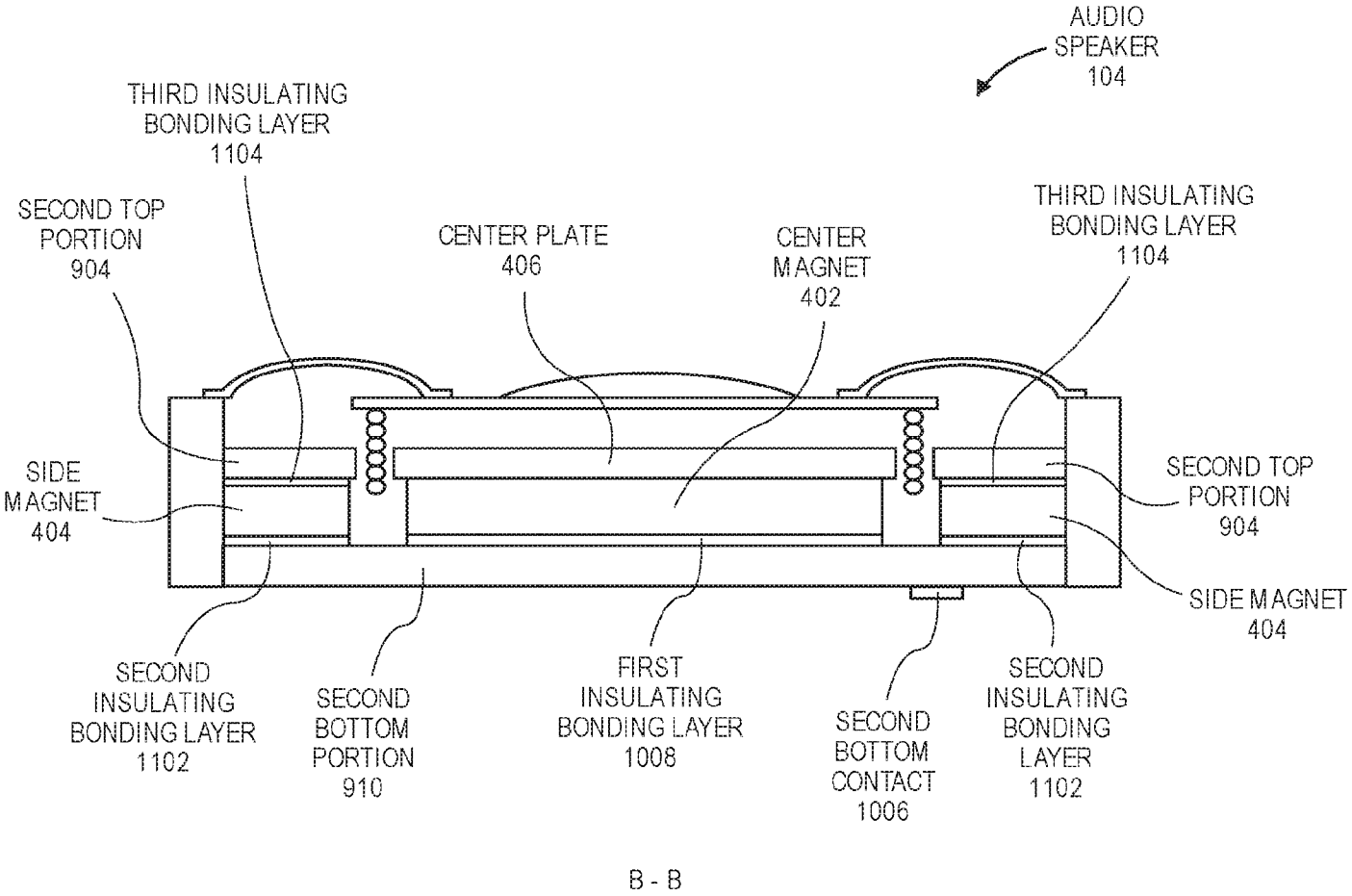
FIG. 11 is a sectional view, taken about line B-B of FIG. 3, of an audio speaker in accordance with an embodiment.

Referring to FIG. 11, a sectional view, taken about line B-B of FIG. 3, of an audio speaker is shown in accordance with an embodiment. The illustrated section line B-B passes through bottom gap 912, and thus, side magnets 404 and corresponding second top portions 904 are sectioned. An end view of second bottom portion 910 is shown, i.e., the section plane faces (but does not section) second bottom portion 910. Center plate 406 and center magnet 402 may be electrically insulated from second bottom portion 910 by first insulating bonding layer 1008, as described above. Thus, electrical shorting between second bottom portion 910 and first bottom portion 908 through center magnet 402 may be prevented.

Side magnet 404, like center magnet 402, may be mounted on one or more of the bottom plate 408 portions. More particularly, side magnet 404 may be mounted on first bottom portion 908 and second bottom portion 910 and extend over bottom gap 912 to form a bridge between first bottom portion 908 and second bottom portion 910. Furthermore, side magnet 404 may be sandwiched between top plate 410 and bottom plate 408, and thus, one or more portions of top plate 410 may be mounted on side magnet 404. For example, first top portion 902 and second top portion 904 may be mounted on side magnet 404. Accordingly, side magnet 404 may provide an electrical short path between portions of top plate 410, between portions of bottom plate 408, and/or between top plate 410 and bottom plate 408. Side magnet 404 may, however, be electrically insulated from top plate 410 and bottom plate 408 to eliminate the electrical short paths.

In an embodiment, a second insulating bonding layer 1102 is disposed between side magnet 404 and bottom plate 408. Second insulating bonding layer 1102 may be similar to insulating bonding layer 602 described above. That is, second insulating bonding layer 1102 may include one or more dielectric spacer, e.g., a first dielectric spacer and a second dielectric spacer, to electrically insulate side magnet 404 from the bottom plate 408 portions. Second insulating bonding layer 1102 may also include an adhesive to securely mount side magnet 404 on the bottom plate 408 portions. Separate second insulating bonding layers 1102 may be disposed beneath respective side magnets 404, i.e., although an identical indicator is used for second insulating bonding layer 1102 beneath each side magnet 404 in FIG. 11, the bonding layers may or may not be applied in a same manufacturing operation. Thus, bottom plate 408 may be electrically insulated from the permanent magnets of the magnet assembly. That is, first insulating bonding layer 1008 and second insulating bonding layer 1102 may electrically insulate bottom plate 408 from center magnet 402 and side magnet 404.

A third insulating bonding layer 1104 may be disposed between side magnet 404 and top plate 410. Third insulating bonding layer 1104 may be similar to insulating bonding layer 602 described above. That is, third insulating bonding layer 1104 may include one or more dielectric spacers, e.g., a third dielectric spacer and a fourth dielectric spacer, to electrically insulate side magnet 404 from the top plate 410 portions. Third insulating bonding layer 1104 may also include an adhesive to securely mount the top plate 410 portions on side magnet 404. Separate third insulating bonding layers 1104 may be disposed over respective side magnets 404, i.e., although an identical numeral is used to identify third insulating bonding layer 1104 over each side magnet 404 in FIG. 11, the bonding layers may or may not be applied in a same manufacturing operation. Thus, top plate 410 may be electrically insulated from the permanent magnets of the magnet assembly. Third insulating bonding layer 1104 may electrically insulate top plate 410 from side magnet 404 and air gap 412 may electrically insulate top plate 410 from center magnet 402.

Figure 12:
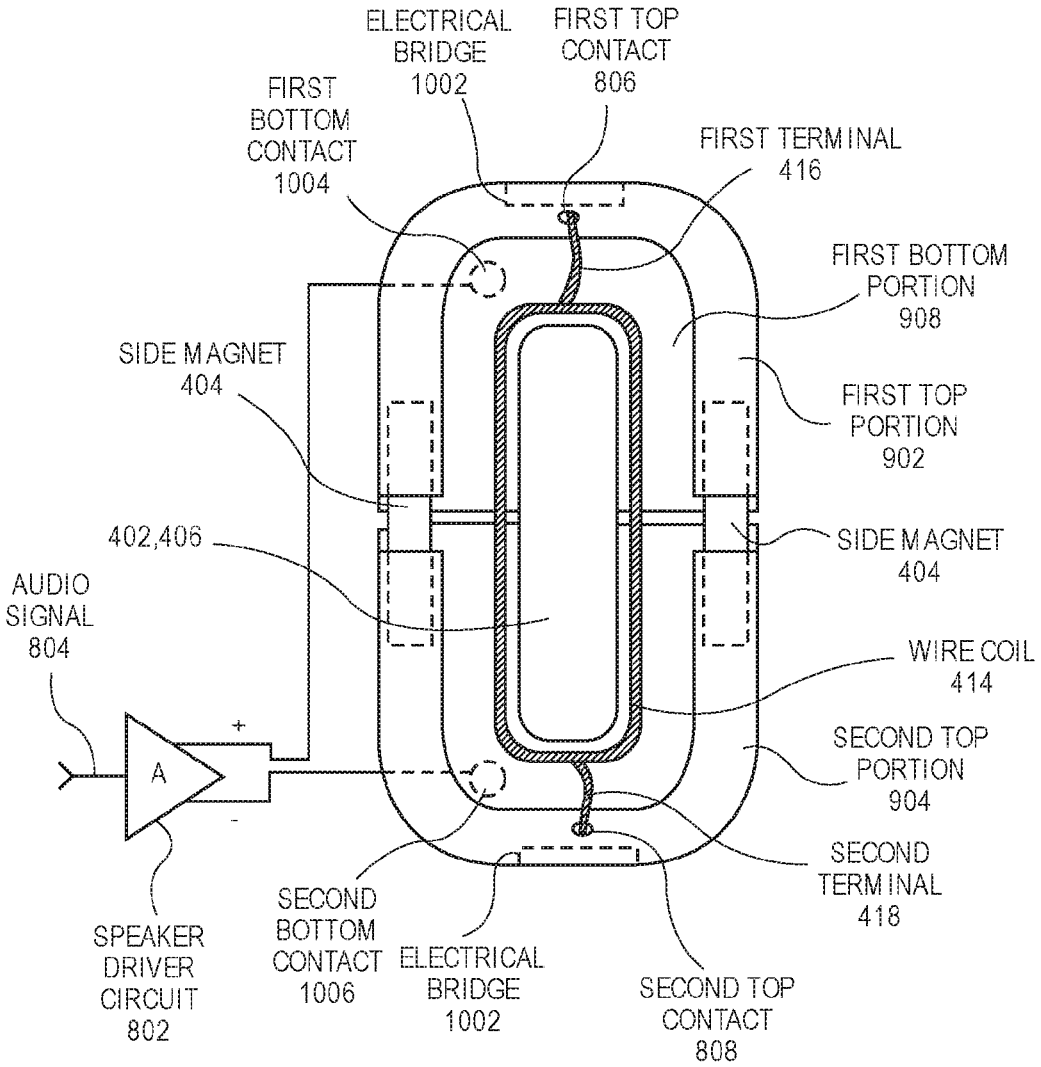
FIG. 12 is a top view of a portion of an audio speaker having a wire coil electrically connected to a magnet assembly in accordance with an embodiment.

Referring to FIG. 12, a top view of a portion of an audio speaker having a wire coil electrically connected to a magnet assembly is shown in accordance with an embodiment. The electrical current path through the magnet assembly may complete an electrical circuit with an external electronic components. For example, first bottom contact 1004 and second bottom contact 1006 may electrically connect to speaker driver circuit 802 through respective leads. The leads may be printed on a main logic board, for example, and speaker driver circuit 802 may be an audio driver amplifier that is also attached to the main logic board. Thus, speaker driver circuit 802 may receive audio signal 804 from electronic device 100 circuitry and amplify the signal to provide the electrical current that passes to audio speaker 104. More particularly, the electrical current may be input to first bottom contact 1004 and output from second bottom contact 1006, or vice versa.

The electrical path between each bottom contact and a respective terminal of wire coil 414 may be located outside of the densest portions of the magnetic field formed by the magnetic circuit of audio speaker 104. For example, the electrical audio signal current may pass from first bottom contact 1004 through first bottom portion 908 and electrical bridge 1002 into first top portion 902 at a side location. The side location may be along a side of top plate 410 that is orthogonal to a side of top plate 410 over side magnet 404. More particularly, the magnetic field may be focused in air gap 412 between center magnet 402 and side magnet 404 in a direction parallel to the long direction of top gap 906 and bottom gap 912, and the electrical current may flow between first bottom contact 1004 and first terminal 416 at a location that is laterally offset from the magnetic flux. Similarly, second bottom contact 1006 and an electrical contact between second terminal 418 of wire coil 414 and second top portion 904 may be laterally offset from the magnetic flux. Thus, electrical current flowing through the magnet assembly of audio speaker 104 may not interfere with magnetic flux flowing through the magnet assembly.

The electrical audio signal current may pass into wire coil 414 through respective terminals. For example, first terminal 416 of wire coil 414 may be attached to first top portion 902 of top plate 410 at a first top contact 806. In an embodiment, first top contact 806 includes a spot weld formed between first terminal 416 and a top surface of first top portion 902. Thus, the electrical current may pass from first top portion 902 to first terminal 416 through the spot weld. First terminal 416 may be spot welded, however, to other surfaces of the magnet assembly. For example, first terminal 416 may be spot welded directly to first bottom portion 908. Accordingly, rather than passing through electrical bridge 1002 and first top portion 902, electrical current may pass from first bottom contact 1004 to first terminal 416 directly through first bottom portion 908.

Second terminal 418 of wire coil 414 may be attached to second top portion 904 of top plate 410 in a manner similar to first terminal 416. More particularly, second terminal 418 may be spot welded to the top surface of second top portion 904 at a second top contact 808. Thus, the electrical current may pass from second top portion 904 to second terminal 418 through the spot weld. Second terminal 418 may be spot welded to other surfaces of the magnet assembly, however, such as second bottom portion 910.

As described above, first top contact 806 and second top contact 808 may be laterally offset from side magnet 404 to separate the electrical current in the magnet assembly from the magnetic flux in the magnet assembly. As such, first top contact 806 may be located along a short length of first top portion 902 and second top contact 808 may be located along a short length of second top portion 904. Center plate 406 and/or center magnet 402 may be located between the top contacts. For example, a line drawn between first top contact 806 and second top contact 808 may pass through or over center magnet 402. Furthermore, in an embodiment, the line passing through the top contacts is orthogonal to a line that is aligned with the long direction of top gap 906 and/or bottom gap 912.

Figure 13:
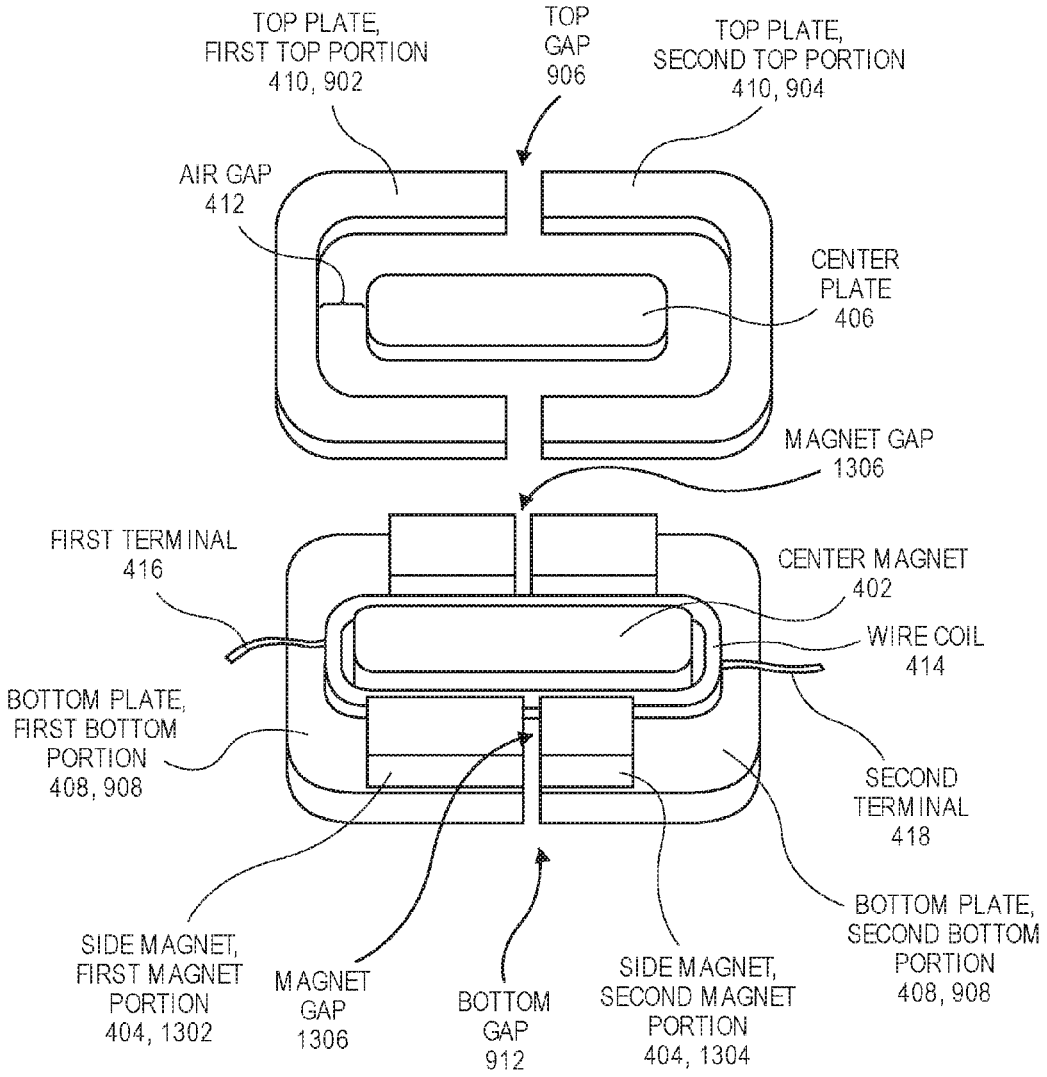
FIG. 13 is an exploded view of a portion of an audio speaker having a magnet assembly and a wire coil in accordance with an embodiment.

Referring to FIG. 13, an exploded view of a portion of an audio speaker having a magnet assembly and a wire coil is shown in accordance with an embodiment. One or more of the side magnets 404 of the magnet assembly may be placed in direct contact with respective top and bottom portions without the need for an intermediate insulating bonding layer 602. More particularly, the magnet assembly illustrated in FIG. 13 may be similar to the magnet assembly illustrated in FIG. 9 except that insulating bonding layers are not disposed between side magnet 404 and respective top and bottom plate portions. Instead, electrical shorting between portions of top plate 410 and portions of bottom plate 408 may be prevented by splitting side magnet 404 into several portions.

The magnet assembly may include top plate 410 segmented into first top portion 902 and second top portion 904, and first top portion 902 may be electrically insulated from second top portion 904 by top gap 906. Similarly, bottom plate 408 may be segmented into first bottom portion 908 and second bottom portion 910, and first bottom portion 908 may be electrically insulated from second bottom portion 910 by bottom gap 912. Side magnet 404 may be sandwiched between the top and bottom portions to form the magnetic circuit having a magnetic field focused in air gap 412. More particularly, the magnetic flux of the magnetic field may traverse an air gap 412 between center plate 406 and top plate 410 portions to interact with an electrical audio signal current delivered through wire coil 414 suspended in air gap 412.

Wire coil 414 may include first terminal 416 and second terminal 418, which may be placed in electrical contact with respective first top portion 902 and second top portion 904 by spot welds, as described above. Thus, electrical current may pass through first top portion 902 and second top portion 904. To prevent electrical shorting from first top portion 902 to second top portion 904 through side magnet 404, side magnet 404 may be segmented into a first magnet portion 1302 and a second magnet portion 1304. First magnet portion 1302 may be sandwiched between first top portion 902 and bottom plate 408, e.g., first bottom portion 908. Second magnet portion 1304 may be sandwiched between second top portion 904 and bottom plate 408, e.g., second bottom portion 910. The magnet portions may furthermore be separated by a magnet gap 1306. Magnet gap 1306 may be configured in a manner similar to top gap 906 and/or bottom gap 912, e.g., may include an air-filled void, a dielectric spacing component, or a dielectric coupling that physically connects first magnet portion 1302 to second magnet portion 1304 while electrically insulating the portions from each other. Thus, first magnet portion 1302 of side magnet 404 may be electrically insulated from second magnet portion 1304 of side magnet 404 by magnet gap 1306.

In an embodiment, the magnet gap 1306 between magnet portions is aligned with one or more of top gap 906 or bottom gap 912 between respective top plate 410 and bottom plate 408 portions. For example, magnet gap 1306, top gap 906, and bottom gap 912, may be air-filled voids placed in fluid communication between a top surface of top plate 410 and a bottom surface of bottom plate 408. Thus, magnet gap 1306 may extend between top gap 906 and bottom gap 912 to form an isolation region between a first half of the magnet assembly electrically connected to first terminal 416 of wire coil 414 and a second half of the magnet assembly electrically connected to second terminal 418 of wire coil 414.

Whereas magnet gap 1306 may create an electrical isolation region between halves of top plate 410 and/or bottom plate 408 without the inclusion of an intermediate insulating bonding layer, each magnet portion may provide a potential electrical path between a top portion and a respective bottom portion. Nonetheless, the electrical audio signal current may preferentially travel between bottom plate 408 and top plate 410 through electrical bridge 1002. Furthermore, the electrical current may follow a path through top plate 410 from electrical bridge 1002 into wire coil 414 rather than traveling around top plate 410 and into the magnet portion. More particularly, electrical bridge 1002 may have a lower electrical resistance than the magnet portion to provide a preferential conductive path for the electrical current. Thus, although the magnet portion may provide a conductive path between top plate 410 and bottom plate 408, the electrical current may follow another path of less resistance such that the electrical current in the electrical circuit of audio speaker 104 is routed along an electrical path that does not interfere with the magnetic field in the magnetic circuit of audio speaker 104.

Although the foregoing specification has described routing an electrical audio signal current through a portion of a magnet assembly, e.g., top plate 410, it will be appreciated that other electrical signals may be routed through one or more portions of the magnet assembly. For example, a capacitive displacement sensor may be used to detect displacement of diaphragm 304, and a sensor signal from the capacitive displacement sensor may be routed through, e.g., center plate 406 or top plate 410. More particularly, diaphragm 304 and top plate 410 may provide separate plate structures of the capacitive displacement sensor. An electrical charge may be applied to diaphragm 304 and top plate 410 by respective electrical paths. In the case of top plate 410, electrical charge may be delivered through, e.g., printed circuit carrier 502, to a conductive pad attached to top plate 410. Accordingly, a change in capacitance between diaphragm 304 and top plate 410 may be detected by external circuitry connected to printed circuit carrier 502 to determine a displacement or relative position of diaphragm 304. Other electrical signals may of course be routed through the magnet assembly in a similar manner.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. An audio speaker, comprising:

a diaphragm;

a magnet assembly having an air gap between an electrically conductive top plate and a center magnet, wherein the electrically conductive top plate laterally surrounds the center magnet; and a voicecoil coupled to the diaphragm and movably suspended in the air gap, wherein the voicecoil includes a first terminal and a second terminal, and wherein the first terminal is in electrical contact with the top plate such that the top plate is electrically connected to the second terminal through the suspended voicecoil.

2. The audio speaker of claim 1 further comprising a printed circuit carrier having a first conductive pad and a second conductive pad, wherein the first conductive pad is in electrical contact with the top plate and the second conductive pad is in electrical contact with the second terminal.

3. The audio speaker of claim 2, wherein the first terminal is attached to the top plate at a first top contact, wherein the first conductive pad is attached to the top plate at a second top contact, and wherein the center magnet is between the first top contact and the second top contact.

4. The audio speaker of claim 3, wherein the first conductive pad is electrically connected to the first terminal through the top plate.

5. The audio speaker of claim 2, wherein the first conductive pad is on a first side of the printed circuit carrier facing the top plate and the second conductive pad is on a second side of the printed circuit carrier facing away from the top plate.

6. The audio speaker of claim 5, wherein the printed circuit carrier is a flexible printed circuit.

7. An audio speaker, comprising:

a diaphragm;

a magnet assembly having a center magnet mounted on an electrically conductive bottom plate and an air gap between the center magnet and an electrically conductive top plate, wherein the top plate includes a first top portion electrically insulated from a second top portion, and wherein the bottom plate includes a first bottom portion electrically insulated from a second bottom portion; and a voicecoil coupled to the diaphragm and movably suspended in the air gap, wherein the voicecoil includes a first terminal and a second terminal, and wherein the first terminal is in electrical contact with the first top portion and the second terminal is in electrical contact with the second top portion such that the first top portion is electrically connected to the second top portion through the suspended voicecoil.

8. The audio speaker of claim 7, wherein the bottom plate is below the center magnet and the top plate, and wherein the first top portion is electrically connected to the first bottom portion and the second top portion is electrically connected to the second bottom portion.

9. The audio speaker of claim 8, wherein the magnet assembly includes a side magnet between the top plate and the bottom plate.

10. The audio speaker of claim 9, wherein the first terminal is attached to the first top portion at a first top contact and the second terminal is attached to the second top portion at a second top contact, and wherein the first top contact and the second top contact are laterally offset from the side magnet.

11. The audio speaker of claim 10 further comprising a first bottom contact on the first bottom portion and a second bottom contact on the second bottom portion, wherein the first bottom contact is electrically connected to the first terminal through the first top portion and the first bottom portion, and wherein the second bottom contact is electrically connected to the second terminal through the second top portion and the second bottom portion.

12. The audio speaker of claim 9, wherein the side magnet extends over a bottom gap between the first bottom portion and the second bottom portion.

13. The audio speaker of claim 12 further comprising a first insulating bonding layer between the center magnet and the bottom plate.

14. The audio speaker of claim 13 further comprising a second insulating bonding layer between the side magnet and the bottom plate.

15. The audio speaker of claim 14 further comprising a third insulating bonding layer between the side magnet and the top plate.

16. The audio speaker of claim 15, wherein the insulating bonding layers include respective adhesives and dielectric spacers.

17. An audio speaker, comprising:

a diaphragm;

a magnet assembly having a center magnet mounted on a bottom plate and an air gap between the center magnet and a top plate, wherein the top plate includes a first top portion electrically insulated from a second top portion by a top gap, and wherein the magnet assembly includes a side magnet having a first magnet portion electrically insulated from a second magnet portion by a magnet gap, the first magnet portion between the first top portion and the bottom plate and the second magnet portion between the second top portion and the bottom plate; and a voicecoil coupled to the diaphragm and movably suspended in the air gap, wherein the voicecoil includes a first terminal and a second terminal, wherein the first terminal is in electrical contact with the first top portion, and wherein the second terminal is in electrical contact with the second top portion such that the first top portion is electrically connected to the second top portion through the suspended voicecoil.

18. The audio speaker of claim 17, wherein the bottom plate includes a first bottom portion electrically insulated from a second bottom portion by a bottom gap, wherein the first magnet portion is between the first top portion and the first bottom portion, and wherein the second magnet portion is between the second top portion and the second bottom portion.

19. The audio speaker of claim 18 further comprising a first dielectric spacer between the first magnet portion and the first top portion, a second dielectric spacer between the second magnet portion and the second top portion, a third dielectric spacer between the first magnet portion and the first bottom portion, and a fourth dielectric spacer between the second magnet portion and the second bottom portion.

20. The audio speaker of claim 19, wherein the magnet gap extends between the top gap and the bottom gap.

21. A device, comprising:

an audio speaker including a diaphragm, a magnet assembly having an air gap between an electrically conductive top plate and a center magnet, wherein the electrically conductive top plate laterally surrounds the center magnet, and a voicecoil coupled to the diaphragm and movably suspended in the air gap, wherein the voicecoil includes a first terminal and a second terminal, and wherein the first terminal is in electrical contact with the top plate such that the top plate is electrically connected to the second terminal through the suspended voicecoil.

22. The device of claim 21 further comprising:

a speaker driver circuit; and a printed circuit carrier electrically coupled to the speaker driver circuit and the audio speaker, wherein the printed circuit carrier has a first conductive pad and a second conductive pad, wherein the first conductive pad is in electrical contact with the top plate and the second conductive pad is in electrical contact with the second terminal.

23. The device of claim 22 further comprising one or more of a display or a microphone.

24. The device of claim 22, wherein the first conductive pad is electrically connected to the first terminal through the top plate.

* * * * *